US012042024B2

(12) United States Patent
Hörtnagl

(10) Patent No.: US 12,042,024 B2
(45) Date of Patent: Jul. 23, 2024

(54) BUCKLE COMPONENT

(71) Applicant: ABA Hörtnagl GmbH, Medraz (AT)

(72) Inventor: Andreas Hörtnagl, Fulpmes (AT)

(73) Assignee: ABA Hörtnagl GmbH, Fulpmes (AT)

( * ) Notice: Subject to any disclaimer, the term of this patent is extended or adjusted under 35 U.S.C. 154(b) by 0 days.

(21) Appl. No.: 17/669,489

(22) Filed: Feb. 11, 2022

(65) Prior Publication Data

US 2022/0256980 A1 Aug. 18, 2022

(30) Foreign Application Priority Data

Feb. 15, 2021 (AT) ..... A 31/2021

(51) Int. Cl.

| | |
|---|---|
| ***A44B 11/12*** | (2006.01) |
| ***A44B 11/06*** | (2006.01) |
| ***A44B 11/10*** | (2006.01) |
| ***A44B 11/25*** | (2006.01) |

(52) U.S. Cl.

CPC ..... *A44B 11/2573* (2013.01); *A44B 11/065* (2013.01); *A44B 11/10* (2013.01); *A44B 11/2507* (2013.01)

(58) Field of Classification Search

CPC ... A44B 11/2573; A44B 11/065; A44B 11/10; A44B 11/2507; A44B 11/14; A44B 11/12; Y10T 24/4077; Y10T 24/4074; Y10T 24/4016

See application file for complete search history.

(56) References Cited

U.S. PATENT DOCUMENTS

| | | | | |
|---|---|---|---|---|
| 5,893,199 | A | 4/1999 | Anscher | |
| 6,360,410 | B1 | 3/2002 | Lovato | |
| 2003/0041420 | A1 | 3/2003 | Kosh et al. | |
| 2008/0028578 | A1* | 2/2008 | Vaccaro | A63B 33/002 24/593.11 |
| 2010/0243373 | A1* | 9/2010 | Johnson | A44B 11/2557 24/171 |
| 2013/0185902 | A1 | 7/2013 | Kaneko | |
| 2013/0305493 | A1* | 11/2013 | Hortnagl | A44B 11/14 24/170 |
| 2019/0208868 | A1* | 7/2019 | Wong | A44B 11/065 |
| 2020/0163418 | A1* | 5/2020 | Morgan | A44B 11/10 |
| 2020/0281327 | A1* | 9/2020 | Ben-Arie | A44B 11/12 |

FOREIGN PATENT DOCUMENTS

| | | |
|---|---|---|
| DE | 1557513 | 4/1970 |
| EP | 3053473 | 8/2016 |
| IT | ITUA20162131 A1 | 10/2017 |
| WO | 2012109682 | 8/2012 |

* cited by examiner

*Primary Examiner* — Robert Sandy

*Assistant Examiner* — Michael S Lee

(74) *Attorney, Agent, or Firm* — Volpe Koenig

(57) ABSTRACT

A buckle component (1, 2) having a main body (3) and a clamping web (4), the main body (3) having a belt-receiving opening (5), and the clamping web (4) being mounted displaceably on the main body (3) in the belt-receiving opening (5) for clamping a belt (6), which is guided around the clamping web (4), between the clamping web (4) and an edge (7) of the main body (3) bounding the belt-receiving opening (5). The buckle component (1, 2) additionally has a flap (8) which is mounted pivotably on the main body (3) by a pivot joint (9), and the flap (8) has a clamping surface (10) for clamping the belt (6) between the clamping surface (10) of the flap (8) and the clamping web (4) in a clamping position of the flap (8).

17 Claims, 7 Drawing Sheets

BUCKLE COMPONENT

INCORPORATION BY REFERENCE

The following documents are incorporated herein by reference as if fully set forth: Austrian Patent Appln A 31/2021, filed Feb. 15, 2021.

BACKGROUND

The present invention relates to a buckle component having a main body and a clamping web, the main body having a belt-receiving opening, and the clamping web being mounted displaceably on the main body in the belt-receiving opening for clamping a belt, which is guided around the clamping web, between the clamping web and an edge of the main body bounding the belt-receiving opening.

Buckle components of this type are known per se in a multiplicity of embodiments. In the case of such buckle components, the clamping web is mounted displaceably in the belt-receiving opening such that a belt, which is guided around said clamping web, can be clamped between the clamping web and an edge of the main body bounding the belt-receiving opening.

A buckle component of the type in question is shown, for example, in WO 2012/109682 A1. The use of the displaceably mounted clamping web has the advantage that this permits a very rapid adjustment of the belt in the buckle component. However, a disadvantage of this technology is that the belt is generally clamped sufficiently firmly between the clamping web and the edge of the main body bounding the belt-receiving opening only for as long as a corresponding tension on the belt is maintained. If said tension on the belt is no longer present or is no longer present to a sufficient extent, the clamping connection between clamping web and the edge bounding the belt-receiving opening is loosened. This can then lead to an inadvertent adjustment of the belt in the buckle component.

This problem has also already been described in WO 2012/109682 A1. To solve this problem, this document proposes, in addition to the buckle or the buckle components, a device, which is designed as a separate component, for avoiding an unintentional adjustment of the belt. However, this in turn likewise has the disadvantage that, in addition to the buckle components of the buckle, a separate component always has to be provided in order to prevent an unintentional adjustment or slippage of the belt in the buckle component. In addition, in such solutions, there is of course also the risk of said additional component being lost.

SUMMARY

It is therefore the object of the invention to propose a solution which eliminates the aforementioned problems and prevents an unintentional adjustment or slippage of the belt in the buckle component.

To solve this problem, the invention proposes, in the case of a buckle component of the type mentioned at the beginning, that the buckle component additionally has a flap which is mounted pivotably on the main body by a pivot joint, wherein the flap has a clamping surface for clamping the belt between the clamping surface of the flap and the clamping web in a clamping position of the flap.

In contrast to the aforementioned prior art, the invention therefore provides a flap which is fastened or formed directly on the buckle component and secures the belt against an unintentional adjustment even if the tension on the belt is momentarily insufficient to ensure that the belt is clamped between the clamping web and the edge bounding the belt-receiving opening. The fact that, in the invention, the flap forms or is part of the buckle component also has the advantage that the flap will not be lost so rapidly and no extra component is required in addition to the buckle component. Above all, however, the invention also makes provision for the flap with its clamping surface to clamp the belt directly between the clamping surface of the flap and the clamping web. By this means, the belt is directly secured at the clamping web against an unintentional slippage between the clamping web and the edge bounding the belt-receiving opening even if the tension on the belt eases. Owing to the clamping of the belt at the clamping web by the clamping surface of the flap, the clamping web itself is also secured in its clamping position in relation to the edge bounding the belt-receiving opening, which is a further advantage of the invention.

The flap also has the advantage that it can very simply, by opening and closing, be folded to and fro between the clamping position and a release position, wherein, in the clamping position, the belt is simply clamped between the clamping surface of the flap and the clamping web, and, in the release position, the clamping surface is lifted off the belt, such that, in the release position, an adjustment of the belt on the buckle component is possible in a simple manner.

In the case of the buckle component, it is advantageously provided that said buckle component can be connected releasably to a mating buckle component to form a buckle. This can be a belt buckle which serves to connect two belts releasably to each other. The two buckle components, which are connected to each other to form the buckle, or just one thereof, can be designed according to the invention. Advantageous embodiments make provision for the buckle component according to the invention to have a plug-in extension for fastening in a plug-in extension receptacle of a mating buckle component, or for the buckle component according to the invention to have a plug-in extension receptacle for fastening a plug-in extension of a mating buckle component in the plug-in extension receptacle.

If an arrangement having a belt and a buckle component according to the invention is considered, it is likewise advantageously provided there that, in the clamping position of the flap, the belt is clampable or clamped between the clamping surface of the flap and the clamping web.

In order to secure the flap in the clamping position and to prevent an inadvertent folding away from the clamping position into the release position, preferred embodiments of the invention make provision for the flap to be lockable on the main body in the clamping position by a locking device. Said locking device can be formed on the flap or can be part of the flap. In other embodiments, however, the locking device can also be formed, or at least fixed, on the main body of the buckle component. Preferred embodiments make provision for the locking device to be an elastic latching hook. Said latching hook can also be of strip-shaped design. It is preferably fixed or formed on the flap. As already mentioned, the latching hook, however, can also be fixed or formed on the main body of the buckle component.

In preferred variants, in the clamping position, the locking device for locking the flap engages behind an outer side of the main body that is averted from the belt-receiving opening. In these embodiments, the locking device therefore does not engage in the belt-receiving opening, which would, however, also be possible in principle in other embodiments. An advantage of the embodiments in which the locking device engages behind an outer side of the main body that is averted from the belt-receiving opening is that the flap is thereby held relatively readily and stably on the main body in the clamping position. Provision is particularly preferably made for the locking device to be arranged or formed on a side of the flap lying opposite the pivot joint, or to act on the flap.

Within the context of as simply and reliably as possible applying the forces required for clamping the belt, provision is made, in preferred variants, for the clamping surface of the flap to be arranged in a region between the pivot joint and the locking device. It is particularly preferably provided that the clamping surface is formed as a surface of a spring tongue of the flap. Due to the spring tongue, the clamping surface is advantageously elastically pretensioned in the direction of the clamping position, which is advantageous within the context of securely clamping the belt between clamping surface and clamping web. In addition, the use of a spring tongue has the advantage that belts of very differing thickness can thereby be securely clamped between the clamping surface and the clamping web since an automatic adaptation to the respective thickness of the belt takes place by the spring tongue and the elastic deflection thereof.

By appropriate configurations of the surfaces, the clamping of the belt between the clamping surface and the clamping web can be designed as a pure frictional connection. However, in preferred embodiments of the invention, a toothing for form-fitting engagement in the belt is formed on the clamping surface. In these embodiments, the belt is therefore held between clamping surface and clamping web not only in a frictionally locking manner but also in a form-fitting manner when the flap is in the clamping position. Within this context, particularly preferred variants also make provision for a toothing for form-fitting engagement in the belt to be formed on the locking device. This is particularly advantageous whenever the locking device is designed as an elastic latching hook. The toothings can be designed as individual teeth both on the clamping surface and on the locking device, but can also be designed as tooth strips or the like or simply distributed extensively on the clamping surface or the locking device.

In this connection, in particularly preferred variants, the toothing(s) has/have, in mutually opposite directions, tooth flanks which differ in steepness and which, in the clamping position of the flap, permit a re-tensioning of the belt in a tensioning direction and lock the belt in a counter direction opposite to the tensioning direction. In such embodiment variants, owing to the correspondingly differently steep design of the tooth flanks, it can be ensured that, firstly, the steeper tooth flanks securely hold the belt, but, secondly, the tooth flanks which are of less steep design permit a re-tensioning of the belt without the flap having to be released from the clamping position for this purpose.

There are basically various possibilities for forming the flap and the pivot joint and also with regard to the matter of how the flap is fastened to the buckle component. For example, it is provided, in preferred embodiments, that the pivot joint is formed between the flap and a flap carrier and the flap carrier is fastened or fastenable to the main body by a latching connection. However, the flap carrier could just as readily also be arranged or formed fixedly on the main body of the buckle component. The advantages of fastening the flap to the main body of the buckle component by the latching connection mentioned consist in that the flap can in principle also be retrofitted or is fastened to the buckle component only if it is also required. The latching connection between flap carrier and main body advantageously provides a latching lug and a latching lug receptacle, wherein, for fastening the flap to the main body, the latching lug is simply inserted into the latching lug receptacle and latched there. By release of said latching connection, the flap can then also be removed again from the buckle component in a simple manner. The latching lug receptacle is advantageously designed as a hole, particularly preferably as a through hole, in the main body of the buckle component. In these embodiments, the latching lug is then located on the flap carrier. Of course, embodiments the other way around are also conceivable in which the latching lug receptacle is formed on the flap carrier and the latching lug on the main body of the buckle component.

There is also a wide variety of possibilities for the configuration of the pivot joint. In a preferred variant, the pivot joint is a single axle joint with an axle bolt. However, the pivot joint may also be designed, for example, as a film hinge or the like.

Both the buckle component and the flap, and also the flap carrier, can be formed from very different materials. The buckle component and in particular the main body and the clamping web are preferably composed of metal, for example aluminum, an aluminum alloy or stainless steel. However, these components could of course also be formed from plastic or ceramic. The flap and also the flap carrier are preferably formed from plastic. As alternative, however, it would also be conceivable to form the flap and also the flap carrier from metal, in particular from a resilient metal.

BRIEF DESCRIPTION OF THE DRAWINGS

Further features and details of preferred embodiments of the invention will be explained by way of example in the following description of the figures with reference to two embodiment variants according to the invention. In the figures.

DETAILED DESCRIPTION

Figure 1:
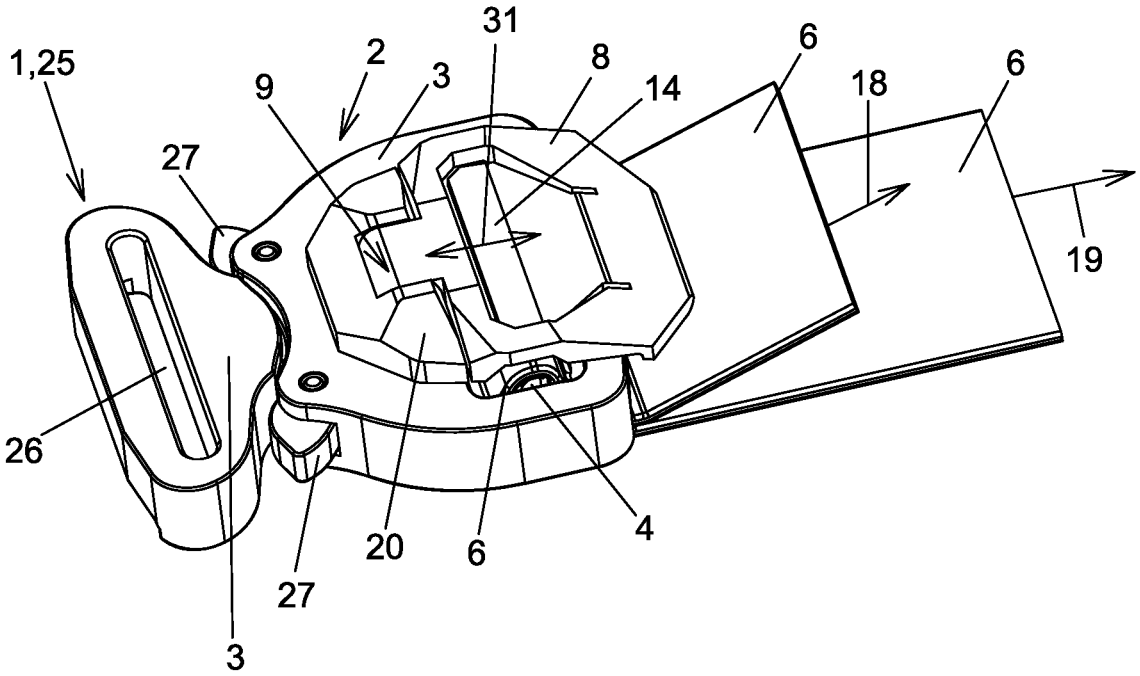
FIGS. 1 to 8 show illustrations for a first exemplary embodiment according to the invention.

In the two embodiment variants of the invention that are shown in the figures, the buckle component 1 or 2 according to the invention is part of a buckle or belt buckle by the buckle component 1 or 2 according to the invention being able to be connected to a mating buckle component 25 to form a buckle. This connection of the buckle components to the mating buckle components is known per se and can be designed as per the prior art for realizing the invention in a wide variety of embodiments. It is favorable here if, as also realized in the embodiment variants shown here, in the plugged-together state the buckle component 1 or 2 and the mating buckle component 25 are lockable to each other. For this purpose, the prior art discloses a wide variety of locking forms which can also be unlocked when the buckle component 1 or 2 is intended to be detached from the mating buckle component 25. The invention can also be combined with all of these types of locking known in the prior art. However, for the sake of completeness, it is also pointed out that buckle components 1 and 2 according to the invention may also already form a complete buckle. In these embodiments of the invention, provision is then not made for the buckle component according to the invention to be able to be connected to a mating buckle component to form a buckle.

In the first exemplary embodiment according to FIGS. 1 to 8, the female buckle component 2 of the buckle is designed according to the invention. This buckle component 2 according to the invention of the first exemplary embodiment can be connected, as illustrated in FIGS. 1 to 6, to another, male buckle component 1 which is known per se. In this exemplary embodiment, the male buckle component 1 therefore forms the mating buckle component 25. In the first exemplary embodiment, the male buckle component 1 has merely one belt slot 26 through which a belt can be guided.

The female buckle component 2 which is designed according to the invention in the first exemplary embodiment has a belt-receiving opening 5 in which a clamping web 4 is mounted so as to be displaceable to and fro in the displacement directions 31. A belt 6 can be guided around the clamping web 4 in the belt-receiving opening 5. By corresponding tension in the counter direction 19, the clamping web 4 is pulled or displaced from the belt 6 in a manner known per se toward the edge 7 bounding the belt-receiving opening 5, as a result of which the belt 6 is clamped between the clamping web 4 and edge 7. This clamping ensures that the belt is fixed on the buckle component 2 for as long as a corresponding tension in direction 19 is maintained. If said tension in direction 19 eases or if tension is applied to the belt 6 in the tensioning direction 18, this clamping of the belt between the clamping web 4 and the edge bounding the belt-receiving opening 5 no longer suffices to hold the belt in its position on the buckle component 2. In order, in such situations, to prevent the belt 6 from being inadvertently displaced or loosened in the buckle component 2, the invention makes provision for the buckle component 2 to additionally have a flap 8 which is mounted pivotably on the main body 3 by a pivot joint 9, wherein the flap 8 has a clamping surface 10 for clamping the belt 6 between the clamping surface 10 of the flap 8 and the clamping web 4 in a clamping position of the flap 8.

Figure 2:
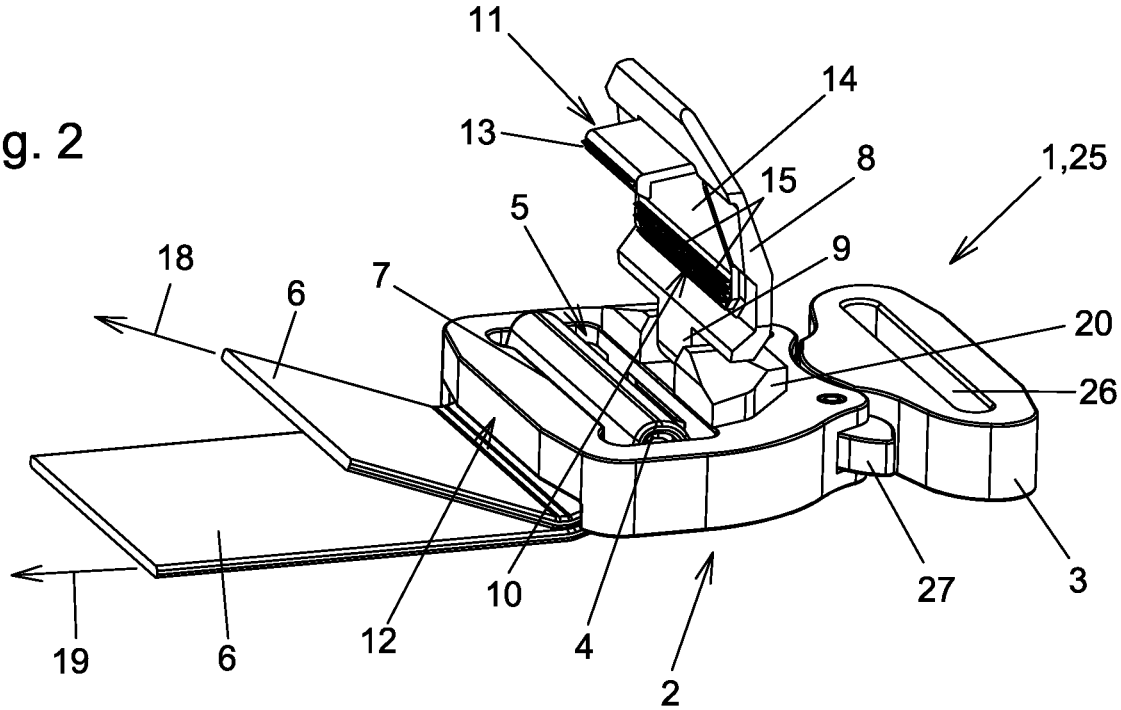
Figure 3:
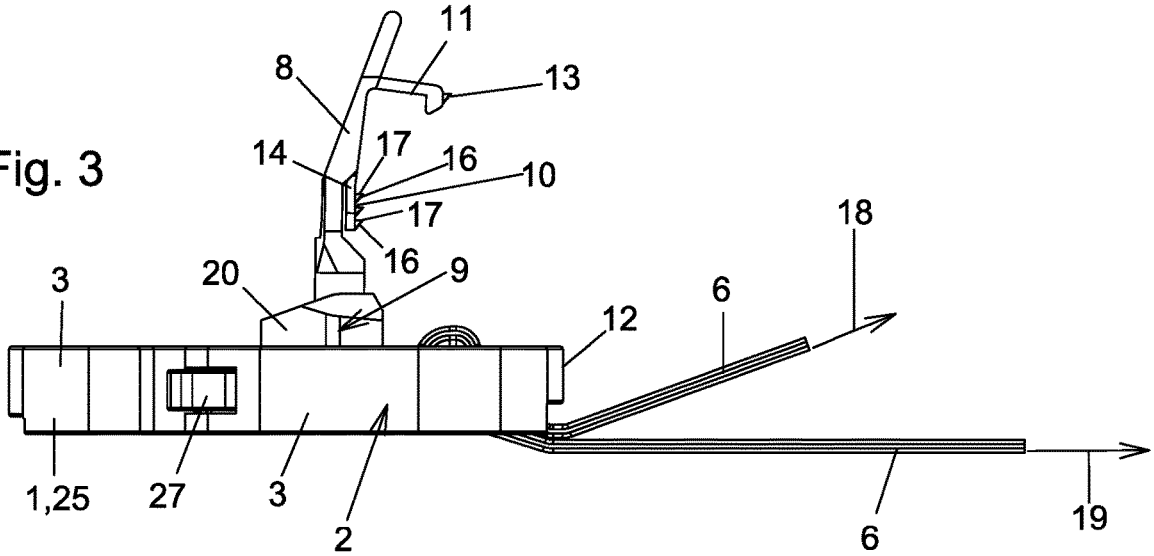
Figure 4:
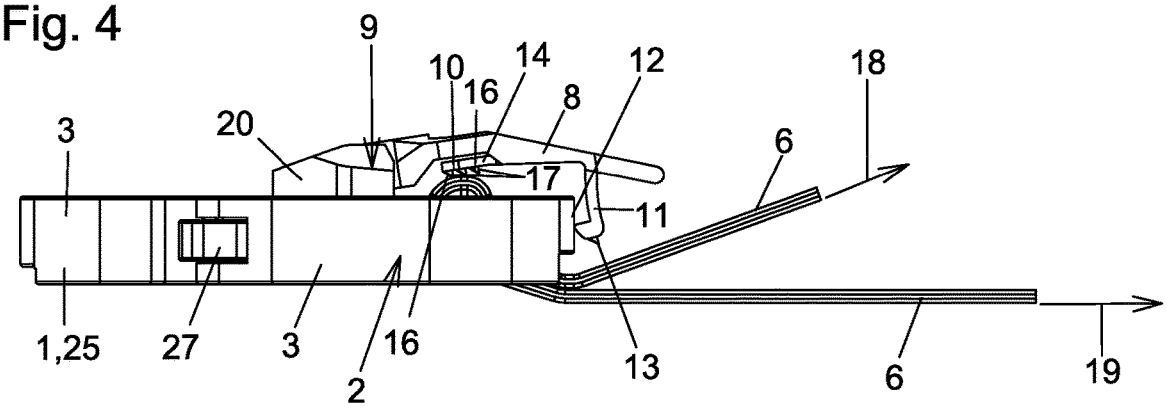
Figure 5:
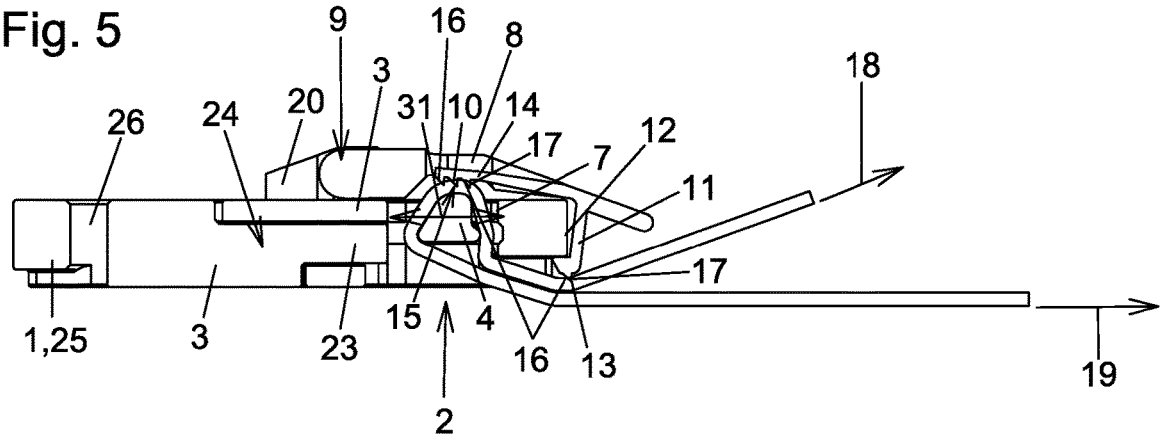
Figure 6:
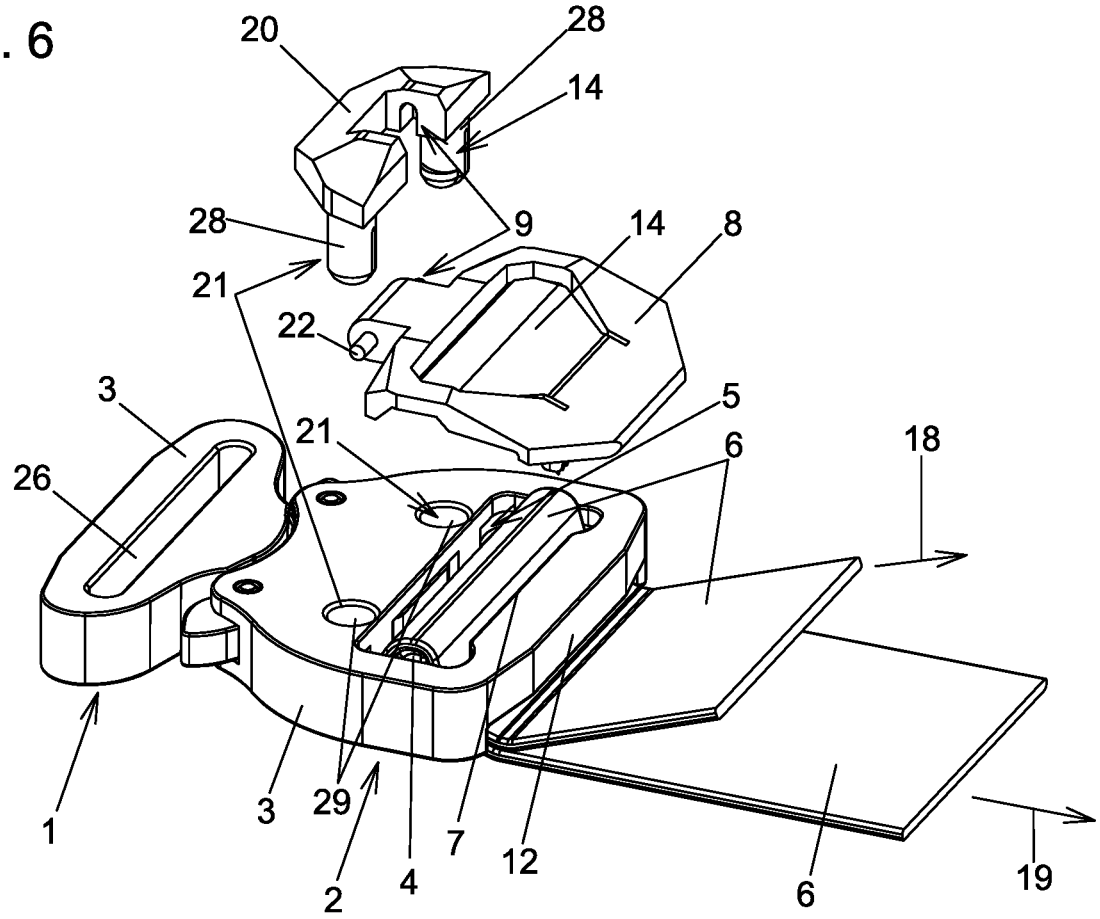
Figure 7:
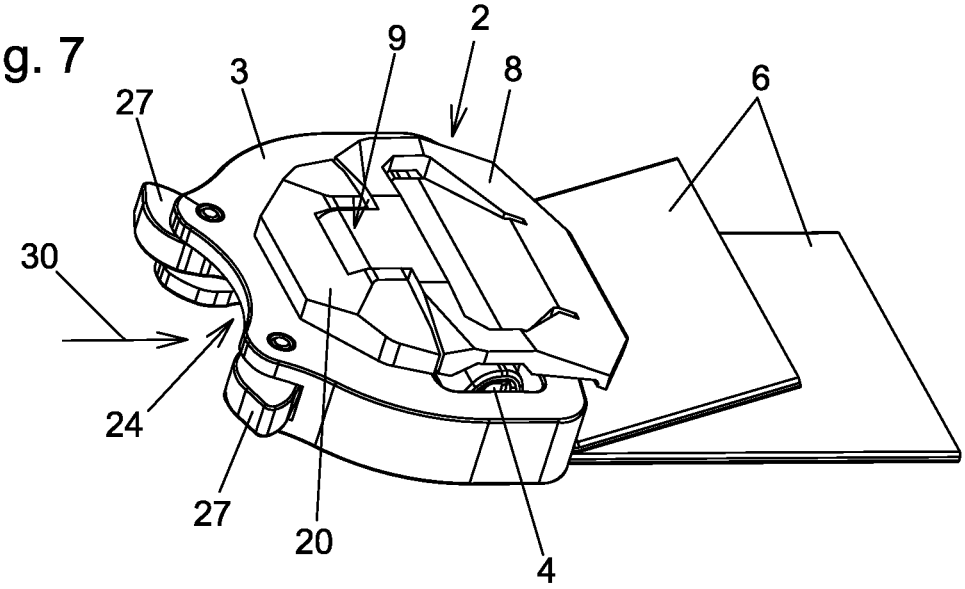
Figure 8:
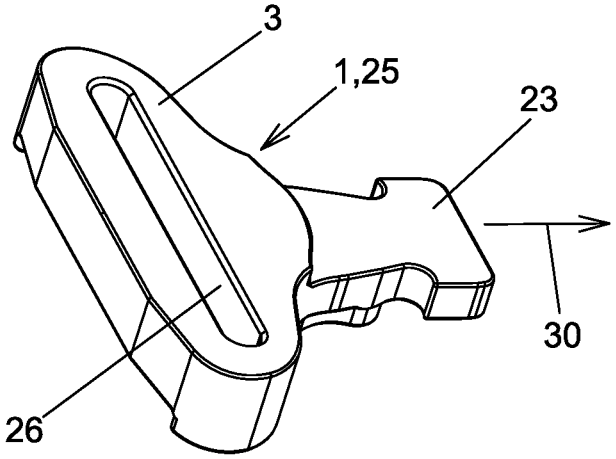

FIG. 1 shows, in a perspective illustration, the female buckle component 2 according to the invention together with the male buckle component 1, which is used here as the mating buckle component 25, in the plugged-together position, wherein the flap 8 is in the clamping position. In this clamping position, the belt 6 is clamped between the clamping surface 10 of the flap 8 and the clamping web 4. FIG. 2 shows a perspective illustration of the flap in its release position. FIGS. 3 and 4 show the first exemplary embodiment according to the invention in side views, wherein FIG. 3 shows the release position and FIG. 4 an intermediate position. FIG. 5 shows the first exemplary embodiment of the invention in a longitudinal section, wherein the flap 8 is in the clamping position. FIG. 6 shows a partially exploded illustration in which the flap 8 is illustrated detached from the flap carrier 20 and from the buckle component 2. FIG. 7 shows only the female buckle component 2 according to the invention of this exemplary embodiment together with the belt 6. FIG. 8 shows only the male buckle component 1 which, in this first exemplary embodiment, is used as the mating buckle component 25.

The flap 8 is fastened to the main body 3 of the buckle component 2 so as to be pivotable to and fro about the pivot joint 9 between the release position, illustrated in FIGS. 2 and 3, and the clamping position, illustrated in FIGS. 1 and 5. It can be seen in FIG. 6 that the pivot joint 9 in this exemplary embodiment is a single axle joint with an axle bolt 22. As already explained at the beginning, the pivot joint 9, however, could also be designed, for example, as a film hinge or the like. In the embodiment shown here, as also in other preferred embodiments, the pivot joint 9 is formed between the flap carrier 20 and the flap 8. Provision is made in such variants for the flap 8 to be fastened to the main body 3 of the buckle component 2 by the flap carrier 20. In the exemplary embodiment shown here, this involves a releasable connection between the flap carrier 20 and the main body 3 in the form of a latching connection 21. In this connection, reference is made in particular to FIG. 6. It can be seen there that, in order to form this latching connection 21, in this exemplary embodiment the latching lugs 28 are formed on the flap carrier 20, said latching lugs being inserted into the latching receptacles 29 of the main body 3 and being latched there in order to fasten the flap carrier 20 and therefore also the flap 8 to the main body 3 of the buckle component 2. Such variants have the advantage that the flap 8 can be removed together with the flap carrier 20 in a simple manner from the main body 3 or from the buckle component 2 when they are not required. Retrofitting of flaps 8 on buckle components 2 is thereby also assisted. Of course, in a departure from exemplary embodiments shown here, the latching connection 21 could also be formed differently. For example, the latching lug receptacles 29 could be provided on the flap carrier 20 and corresponding latching lugs 28 on the main body 3. However, the flap 8 and the flap carrier 20 could also be arranged on the main body 3 of the buckle component 2 in an entirely different way, for example by screwing, adhesive bonding or other forms of fastening that are known per se. The flap carrier 20 could even be a fixed constituent part of the main body 3 of the buckle component 2 according to the invention.

In order to be able to lock the flap 8 on the main body 3 in the clamping position, a locking device 11 is also provided in this first exemplary embodiment. Said locking device is designed here specifically as an elastic latching hook. In the clamping position shown in FIGS. 1 and 5, the locking device 11 engages behind an outer side 12 of the main body 3 that is averted from the belt-receiving opening 5, in order thereby to lock the flap 8 releasably in the clamping position. However, the elastic design of the latching hook means that the locking device 11 can also be readily released in order then to pivot the flap 8 back again from the clamping position, illustrated in FIGS. 1 and 5, into the release position, illustrated in FIGS. 2 and 3. In the release position, the belt 6 can be adjusted in a desired manner in direction 18 or 19. FIG. 4 shows an intermediate position between the clamping position and the release position, which intermediate position is traversed both during opening and during closing of the flap 8. In the clamping position according to FIGS. 1 and 5, the belt is clamped according to the invention between the clamping surface 10 of the flap 8 and the clamping web 4. In preferred embodiments as shown here, the clamping surface 10 is designed as a surface of a spring tongue 14 of the flap 8. The spring tongue 14 can be inherently elastic. However, the spring tongue 14 can also be an inherently rigid body which is pretensioned elastically against the main body of the flap 8 by a corresponding spring or an elastomer body or the like. The pretensioning of the spring tongue 14 is formed at any rate in the direction in which the clamping surface 10 presses against the belt 6 guided around the clamping web 4. Owing to the spring tongue 14, it is also possible to clamp belts 6 of very different thickness securely and in a sufficiently fixed form between the clamping surface 10 and the clamping web 4.

In this exemplary embodiment, provision is also made for the locking device 11 to be arranged or formed on a side of the flap 8 lying opposite the pivot joint 9. The effect which can be achieved by this is that the clamping surface 10 of the flap 8, as also realized here, is arranged in a region between the pivot joint 9 and the locking device 11. It is thereby particularly readily ensured that, in the clamping position, the clamping surface 10 presses sufficiently strongly against the belt 6 guided around the clamping web 4.

In principle, the clamping action between clamping surface 10 and clamping web 4 could be based purely on friction. However, in preferred embodiments such as the embodiments shown here, it is provided that, in addition to the frictionally locking clamping, there is also a form-fitting engagement in the belt 6. For this purpose, in the exemplary embodiments shown here, both the clamping surface 10 and the locking device 11 each have a toothing 15 with which they engage in a form-fitting manner in the belt 6 in the clamping position. The toothings 15 are advantageously in each case an arrangement of a plurality of teeth. The toothings 15 can be designed, for example, as tooth strips, as is also realized here in the exemplary embodiments. Of course, exemplary embodiments are also conceivable in which corresponding toothings 15 are provided either only on the clamping surface 10 or only on the locking device 11.

It can readily be seen in FIGS. 3 to 5 that the toothings 15 realized here have tooth flanks 16 and 17 of differing steepness in mutually opposite directions. The more shallow tooth flanks 16 permit a re-tensioning of the belt 6 in the tensioning direction 18 in the clamping position of the flap 8, while the steeper tooth flanks 17 provide for locking of the belt 6 if tension is applied to the belt 6 in the counter direction 19 opposite to the tensioning direction 18. These preferred embodiments therefore permit the belt 6 to be able to be re-tensioned in the tensioning direction 18 not only in the release position of the flap 8, but also in the clamping position of the flap 8.

As already explained at the beginning, the female buckle component 2 according to the invention of this first exemplary embodiment can be plugged together with the male buckle component 1, which is not designed here according to the invention and which constitutes the mating buckle component 25, to form a buckle. For this purpose, the female buckle component 2, as can readily be seen in FIG. 7, has the plug-in extension receptacle 24 which is known per se and into which the plug-in extension 23, which is visible in FIG. 8, of the buckle component 1 can be pushed in in the plug-in direction 30 in order to connect the two buckle components 1 and 2 to each other. In the exemplary embodiment which is shown here, as also in other preferred embodiments of the invention, in the plugged-together position the male buckle component 1 is locked in the female buckle component 2. Specifically, this is realized in the exemplary embodiments shown here by the catches 27 which are known per se. If the catches 27 are pivoted, as is known per se, into their release position, the two buckle components 1 and 2 can be separated from each other again by the plug-in extension 23 of the buckle component 1 being pulled out of the plug-in extension receptacle 24 of the female buckle component 2 counter to the plug-in direction 30. As already explained at the beginning, this is of course only one example of how such buckle components 1 and 2 can be connected to each other to form a buckle and can also be released from each other again. The invention may also be realized in buckle components of entirely different design.

At any rate, it is advantageous if, as also realized here in these exemplary embodiments, the displacement directions 31, in which the clamping web 4 is displaceable in the belt-receiving opening 5, run orthogonally to the longitudinal extent of the clamping web 4. As likewise realized here in this exemplary embodiment, the displacement directions 31 can be parallel to the plug-in direction 30. In preferred embodiments, as also realized here, the tensioning direction 18 and the counter direction 19 run orthogonally to the longitudinal extent of the clamping web 4.

Figure 9:
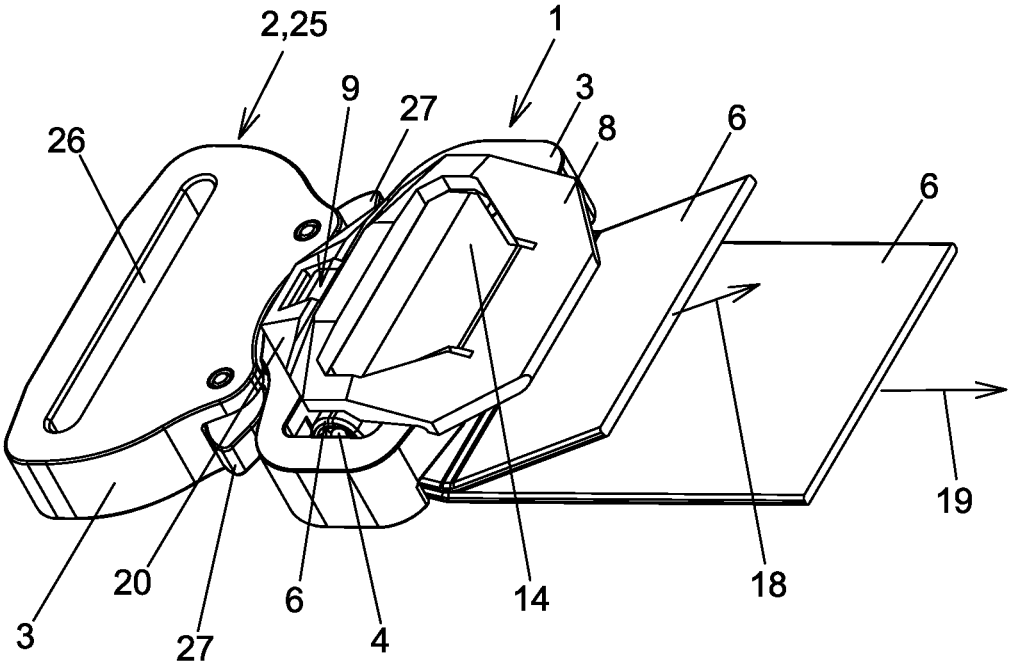
FIGS. 9 to 16 show illustrations for a second exemplary embodiment according to the invention.
Figure 10:
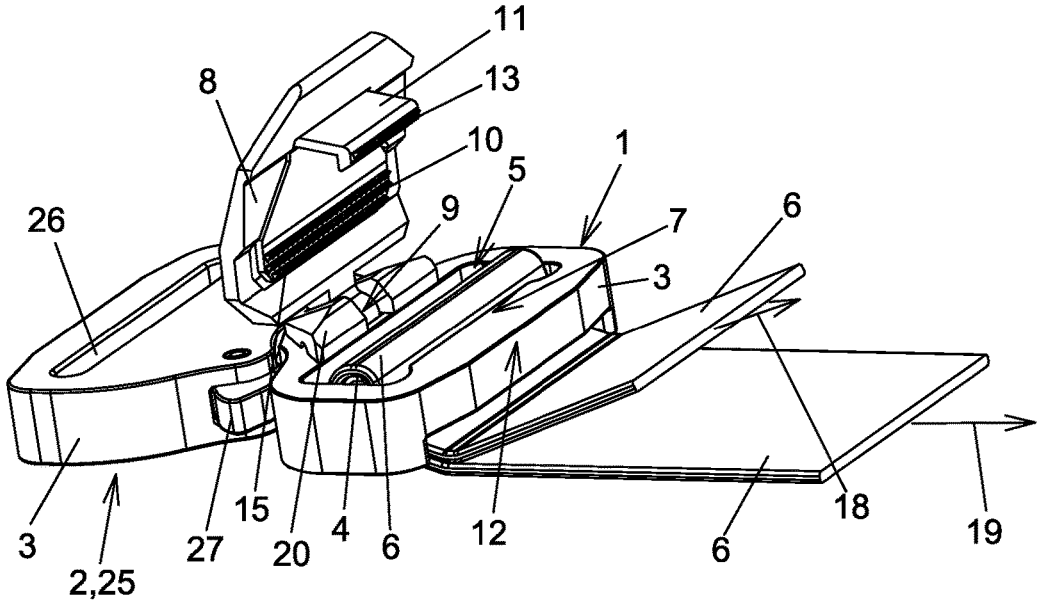
Figure 11:
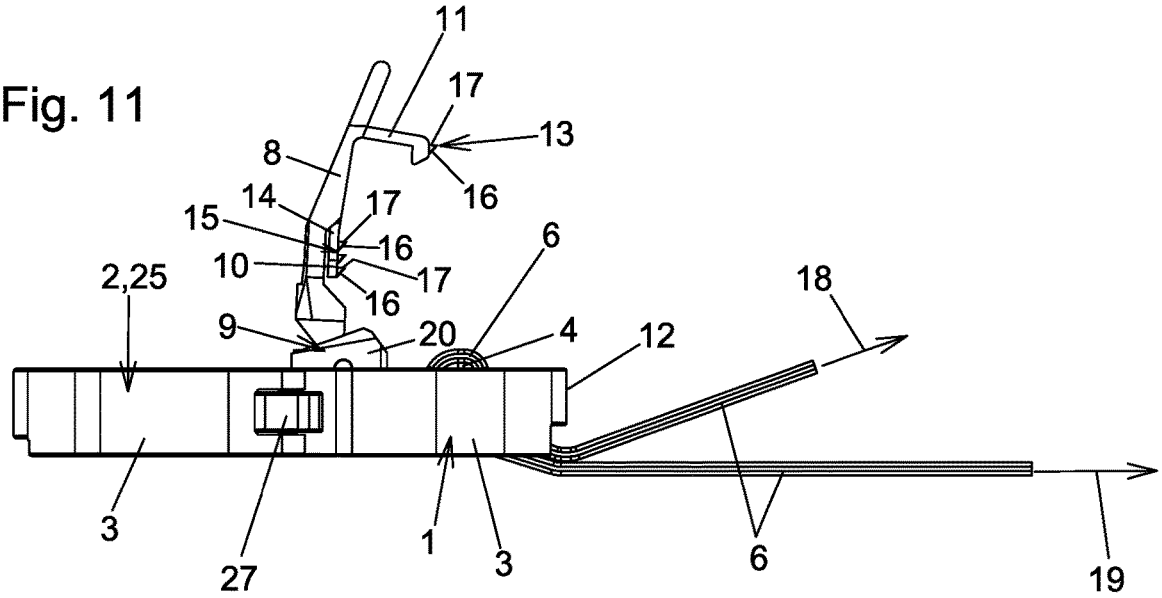
Figure 12:
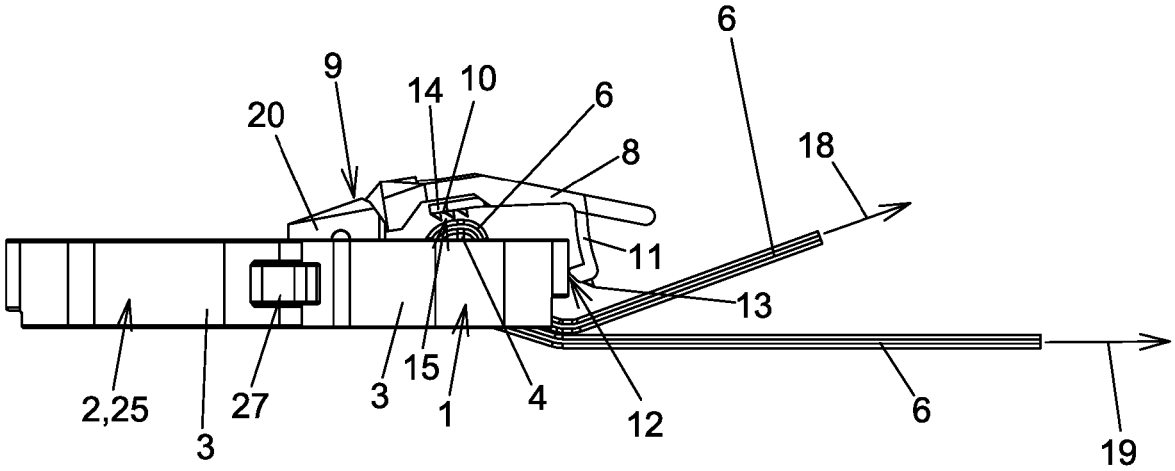
Figure 13:
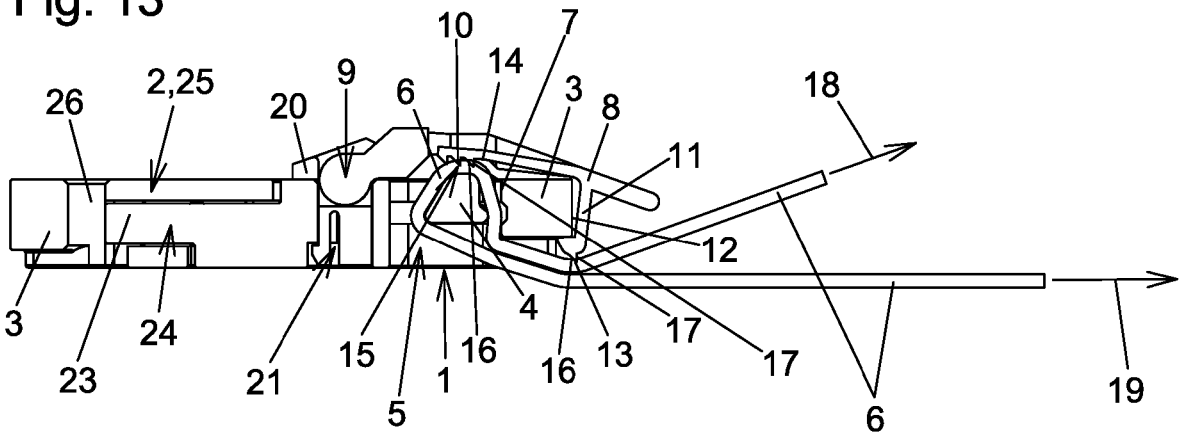
Figure 14:
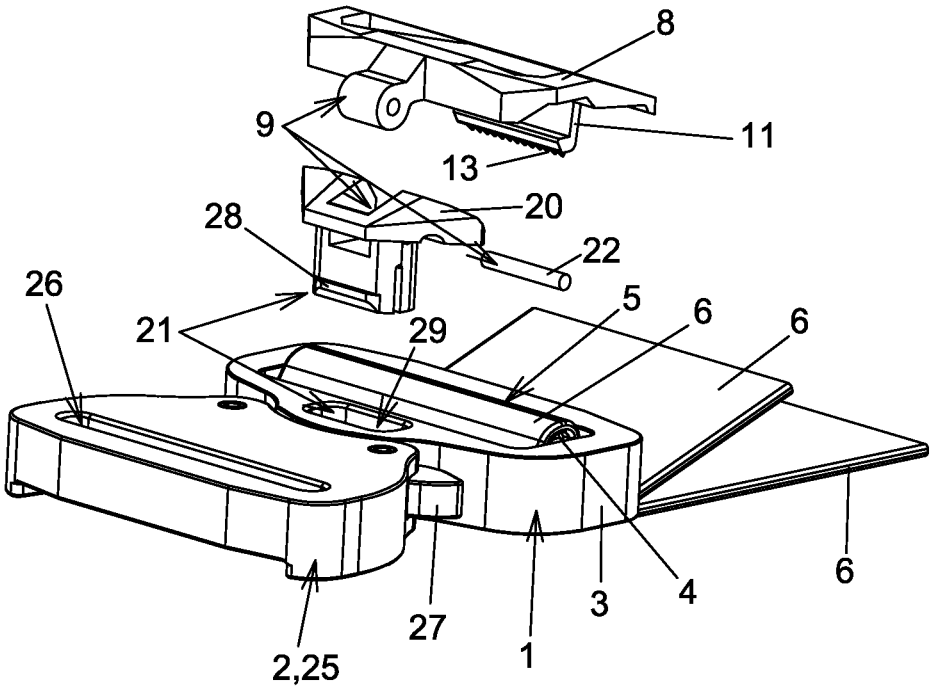
Figure 15:
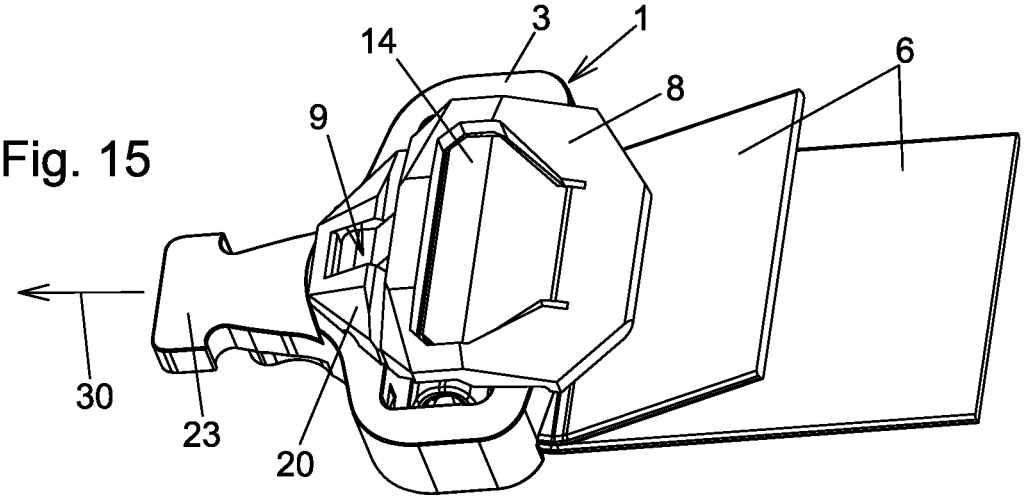
Figure 16:
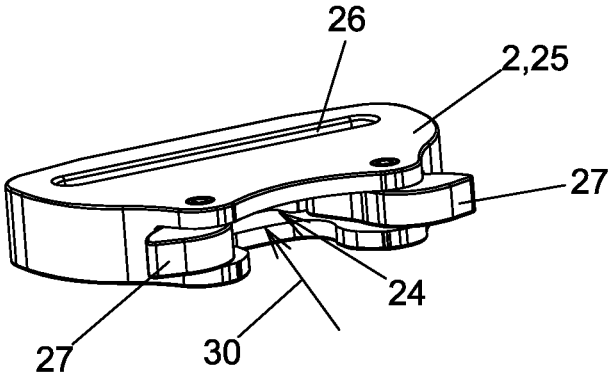

FIGS. 9 to 16 show a second exemplary embodiment according to the invention in which, however, the male buckle component 1 is provided according to the invention with a flap 8, while the female buckle component 2 is designed as known per se in the prior art and here is only the mating buckle component 25 with which the male buckle component 1 according to the invention is joined releasably together to form a buckle. FIG. 9 shows the second exemplary embodiment again in a perspective illustration, wherein the flap 8 arranged on the male buckle component 1 is in the clamping position. FIG. 10 shows a perspective illustration of the buckle of this second exemplary embodiment, wherein the flap 8 is in the release position. FIGS. 11 and 12 in turn show side views, wherein FIG. 11 shows the release position of the flap 8 and FIG. 12 an intermediate position of the flap 8. The clamping position of the flap 8 is illustrated in a longitudinal section in FIG. 13. FIG. 14 shows an exploded illustration in which, in turn, the flap 8, the flap carrier 20 and the axle bolt 22 of the pivot joint 9 are illustrated individually. FIG. 15 shows the male buckle component 1 of this exemplary embodiment detached from the female buckle component 2, which is illustrated separately once again in FIG. 16. Apart from the fact that, in this second exemplary embodiment, the buckle component according to the invention is the male buckle component 1, and that the latching connection 21 illustrated in FIG. 14 is designed somewhat differently than in the first exemplary embodiment, the statements made with regard to the first exemplary embodiment apply analogously to the second exemplary embodiment. For the second exemplary embodiment, reference is therefore also made to the above explanations regarding the first exemplary embodiment in order to avoid unnecessary repetitions.

For the sake of completeness, it is also pointed out that, of course, the female buckle component 2 according to the invention of the first exemplary embodiment can also be plugged together with the male buckle component 1 according to the invention of the second exemplary embodiment to form a corresponding buckle or belt buckle.

KEY TO THE REFERENCE SIGNS

1 buckle component
2 buckle component
3 main body
4 clamping web
5 belt-receiving opening
6 belt
7 edge
8 flap
9 pivot joint
10 clamping surface
11 locking device
12 outer side
13 toothing
14 spring tongue
15 toothing
16 tooth flank
17 tooth flank
18 tensioning direction
19 counter direction
20 flap carrier
21 latching connection
22 axle bolt
23 plug-in extension

24 plug-in extension receptacle
25 mating buckle component
26 belt slot
27 catch
28 latching lug
29 latching lug receptacle
30 plug-in direction
31 displacement direction

The invention claimed is:

1. A buckle component, comprising:

a main body having a belt-receiving opening;

a first clamping mechanism including a clamping web mounted displaceably on the main body in the belt-receiving opening and configured for clamping a belt, which is guided around the clamping web, between the clamping web and an edge of the main body bounding the belt-receiving opening via displacement of the clamping web toward the edge of the main body; and a second clamping mechanism including a flap mounted pivotably on the main body by a pivot joint, the flap including a clamping surface configured such that the belt is clampable between the clamping surface of the flap and the clamping web in a clamping position of the flap.

2. The buckle component as claimed in claim 1, further comprising a locking device configured for locking the flap on the main body in the clamping position.

3. The buckle component as claimed in claim 2, wherein the locking device comprises an elastic latching hook.

4. The buckle component as claimed in claim 2, wherein, in the clamping position, the locking device engages behind an outer side of the main body that is averted from the belt-receiving opening.

5. The buckle component as claimed in claim 2, wherein the locking device is arranged or formed on a side of the flap lying opposite the pivot joint.

6. The buckle component as claimed in claim 2, wherein the locking device acts on the flap on a side of the flap lying opposite the pivot joint.

7. The buckle component as claimed in claim 2, wherein the clamping surface of the flap is arranged in a region between the pivot joint and the locking device.

8. The buckle component as claimed in claim 2, further comprising a toothing for form-fitting engagement in the belt formed on the locking device.

9. The buckle component as claimed in claim 8, wherein the toothing comprises an elastic latching hook.

10. The buckle component as claimed in claim 1, wherein the clamping surface comprises a surface of a spring tongue of the flap.

11. The buckle component as claimed in claim 1, further comprising a toothing for form-fitting engagement in the belt formed on the clamping surface.

12. The buckle component as claimed in claim 11, wherein the toothing includes, in mutually opposite directions, tooth flanks which differ in steepness and which, in the clamping position of the flap, permit a re-tensioning of the belt in a tensioning direction and lock the belt in a counter direction opposite to the tensioning direction.

13. The buckle component as claimed in claim 1, wherein the pivot joint is formed between the flap and a flap carrier, and the flap carrier is fastened or fastenable to the main body by a latching connection.

14. The buckle component as claimed in claim 1, wherein the pivot joint is a single axle joint with an axle bolt.

15. The buckle component as claimed in claim 1, further comprising a plug-in extension for fastening in a plug-in extension receptacle of a mating buckle component.

16. The buckle component as claimed in claim 1, wherein the buckle component has a plug-in extension receptacle for fastening a plug-in extension of a mating buckle component in the plug-in extension receptacle.

17. An arrangement comprising: a belt and the buckle component as claimed in claim 1, wherein, in the clamping position of the flap, the belt is clampable or clamped between the clamping surface of the flap and the clamping web.

* * * * *